US006849125B1

(12) United States Patent
Miller et al.

(10) Patent No.: US 6,849,125 B1
(45) Date of Patent: Feb. 1, 2005

(54) APPARATUS FOR APPLYING FLOWABLE MATERIALS TO MANUFACTURED BUILDING PRODUCTS

(76) Inventors: John C. Miller, 1779 Shell Ring Cir., Mount Pleasant, SC (US) 29466; Patrick R. Iafigliola, 3901 Weathervane La., Crystal Lake, IL (US) 60012

( * ) Notice: Subject to any disclaimer, the term of this patent is extended or adjusted under 35 U.S.C. 154(b) by 0 days.

(21) Appl. No.: 10/763,593

(22) Filed: Jan. 23, 2004

(51) Int. Cl.[7] ..... B05C 11/02

(52) U.S. Cl. ..... 118/114; 118/121; 118/231; 118/304; 427/429

(58) Field of Search ..... 118/114, 121, 118/231, 236, 304, 404, 407, 424; 427/420, 421, 429, 440; 156/578

(56) References Cited

U.S. PATENT DOCUMENTS 3,906,891 A * 9/1975 Roberts ..... 118/707
4,493,857 A * 1/1985 Knigge et al. ..... 430/271.1
6,344,087 B2 * 2/2002 Hein ..... 118/262

* cited by examiner

*Primary Examiner*—Laura Edwards
(74) *Attorney, Agent, or Firm*—Baniak Pine & Gannon

(57) ABSTRACT

A device is provided for flooding a flowable material onto and/or into a manufactured building product. The device includes a framework. A flood system is arranged in the framework to apply the flowable material to manufactured building product. An infeed station including a drive roller and a metering roller is arranged at the infeed end of the apparatus. One or both of the drive roller and metering roller are releasably coupled to a drive motor positioned outside of the framework. An adjusting mechanism may be provided for adjusting the relative vertical position of the metering roller with respect to the drive roller. At least one brush station includes an upper brush and a lower brush positioned downstream from the infeed station. The upper brush and the lower brush are releasably coupled to one or more drive motor positioned outside of the framework.

19 Claims, 5 Drawing Sheets

APPARATUS FOR APPLYING FLOWABLE MATERIALS TO MANUFACTURED BUILDING PRODUCTS

FIELD OF THE PRESENT INVENTION

The present invention generally relates to an apparatus for the flooding of a variety of board shaped materials, such as cementitious, wood or board products for siding, trim and other building applications with a variety of flowable materials. In particular, the apparatus of the present invention applies flowable materials like colorants, preservatives and protectants in a fluid or fluid-like form to manufactured products for exterior building applications.

BACKGROUND OF THE INVENTION

A wide range of manufactured materials are employed in the construction and finishing of buildings and homes. The materials may be in the form of siding, trim and decking, for example. These manufactured materials include natural wood, such as cedar, fir, pine and so on, cementitious boards, plywood, medium density overlay (typically a high quality paper saturated with phenolic resin overlaid upon an exterior grade plywood core), vinyl panels, etc.

The use of the above manufactured materials in building construction for roofs, siding and roofs is well known. Despite being a relatively "low-tech" material, wood, for example, continues to be a preferred building material for a number of reasons. Wood may be used in an almost unlimited number of configurations and in a wide variety of applications. Because natural wood has low cost, good durability, flexibility application options, ease of installation, high availability, and consistent performance combined with good looks it is used in many such exterior applications.

Because wood is a natural material, it is subject to weathering by exposure to environmental conditions, such as sun, hail, ice and snow, moisture, temperature, wind as well as biological degradation, such as by insects, plants, fungi, etc. Non-wood manufactured materials used in exterior building applications can suffer from similar degradation from the environment. In response, wood-based and other manufactured materials are typically provided with some sort of protectant such as, for example, paint or stain or the like for coloring, preserving and/or protecting the building material.

Application of the protectant on site, while frequently done, may be fraught with risk and is inefficient. Risks include wet materials, temperature-related problems, product contamination, weather delays, wood splitting, cupping and other problems. In response, manufacturers have developed machinery to apply paint and stain to board products and as a result, manufactured board products are available to contractors and the like in a pre-painted or pre-stained condition. A disadvantage of this process is the lack of flexibility regarding protectant materials and colors. Furthermore, modification of the manufactured boards or products is not possible after a final application of protectant.

Machines are available to contractors and others, which variously apply paint or stain and the like to manufactured building products. To date these machines suffer from a lack of flexibility and easy cleaning and changeovers.

It can be appreciated that there is a demand for a device that meets a majority of the above needs and can be easily adapted for various protectants, sizes of manufactured building products and maintained and cleaned with a minimum of expended time or cost. The present invention satisfies this demand.

SUMMARY OF THE INVENTION

An object of the invention is to provide a device for flooding a flowable protectant onto and/or into a manufactured building product. One embodiment of the device is directed to an apparatus for applying a flowable protectant to a manufactured building product including a framework. A flood system is arranged in the framework to apply the protectant to manufactured building product conveyed through the apparatus. An infeed station including a drive roller and a metering roller is arranged at the infeed or input end of the apparatus. One or both of the drive roller and metering roller are releasably coupled to a drive motor positioned outside of the framework. An adjusting mechanism may be provided for adjusting the relative vertical position of the metering roller with respect to the drive roller. At least one brush station including an upper brush and a lower brush is positioned downstream from the infeed station. The upper brush and the lower brush are releasably coupled to one or more drive motor positioned outside of the framework.

Other aspects of the apparatus provide a drive roller positioned below and parallel to the metering roller. The drive roller may include a textured surface. The metering roller may include a neoprene outer surface. The neoprene surface may include a spiral flat strip formed thereupon. The neoprene surface may include a spiral groove defined by the spiral flat strip. The flood system preferably applies protectant to the manufactured products before the infeed station. The brush station may include a first brush station including an upper brush and a lower brush positioned to receive manufactured product from the infeed station and a second brush station including an upper brush and a lower brush, the second brush station positioned to receive manufactured product from the first brush station.

The upper and lower brushes are adapted to respectively brush upper and lower surfaces of the manufactured product. The side brush system may be adapted to contact the sides of the manufactured product. The side brush system may be positioned between the first brush system and the second brush system. The side brush system is adapted to brush side surfaces of the manufactured product. The adjusting mechanism may be provided to vertically adjust the metering roller. An adjusting mechanism adjusts the relative vertical position of the upper brush with respect to the lower brush. The framework may include a pair of spaced side panels. The apparatus further includes a catch basin extending between the pair of spaced side panels and positioned below the infeed station and the brush station. The drive motor and the brush motors are mounted outside of the spaced side panels. One or more of the drive roller, the metering roller, the upper brush and the lower brush is quick release mounted.

These, together with other objects and advantages will be further understood in the details of the construction and operation of the invention as more fully hereinafter described, reference being had to the accompanying drawings, forming a part hereof, wherein like numerals refer to like part throughout.

DESCRIPTION OF PREFERRED EMBODIMENTS

For purposes of the present application, the term manufactured building products will refer to any and all building products, natural, synthetic, and composites thereof, which are generally in board form, which are used in home and other building construction. These include, for example, exterior sidings and trim, wood products like cedar, fir, pine, etc., cementitious boards; medium density overlay (MDO), decking, and so on. For purposes of the present application, protectants will refer to any and all flowable materials, applicable in a fluid or fluid-like form, which function to treat, finish, protect, seal, color, or preserve the manufactured building products, such as, for example, oil or latex based paint, stain, oils, varnish, lacquer, wood preservatives and so on.

Figure 1:
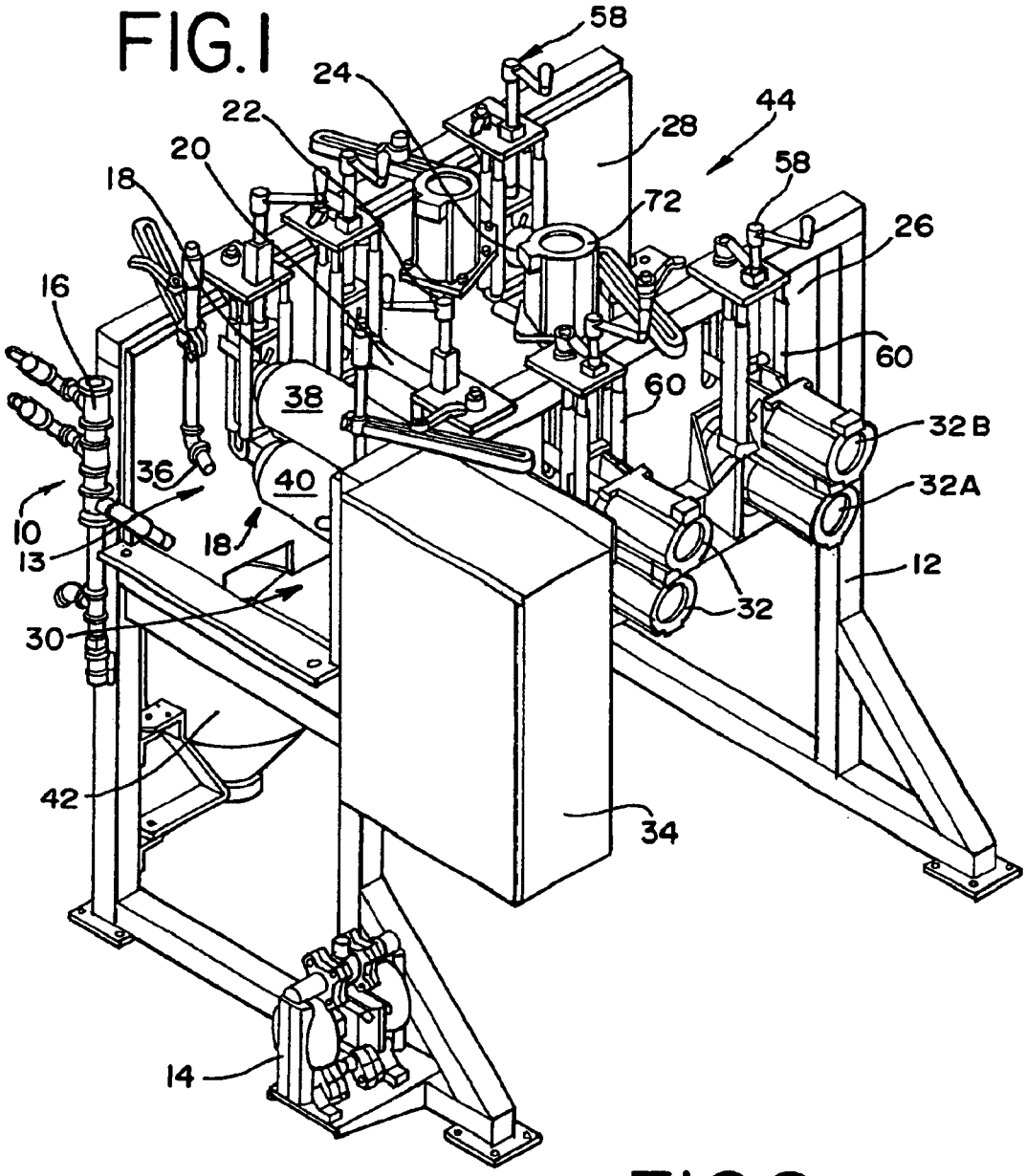
FIG. 1 is a perspective view of one embodiment of an apparatus according to the present invention.
Figure 2:
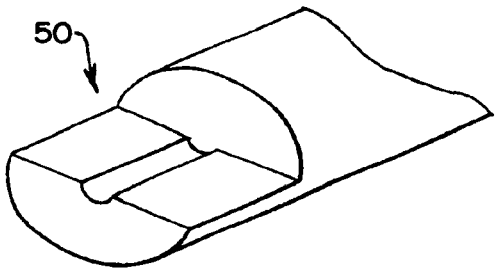
FIG. 2 is a perspective view of a half lap feature of a shaft (drive shaft, roller or brush shaft or stub shaft).

FIG. 1 shows one embodiment of a protectant apparatus according to the present invention generally at 10. In a general overview, the apparatus 10 includes a framework 12 made of any suitable material, preferably welded steel construction and preferably treated to resist corrosion. It will be understood that the framework 12 contemplates any suitable arrangement of structures capable of supporting the below-specified elements of the invention. The framework 12 may be considered to include side panels 26, 28 and a catch basin 30 for retaining and recirculating protectants and for mounting of the various elements of the apparatus 10.

Positioned within or on the framework 12 and in the approximate order of operation, i.e., from an input end or infeed end 13 of the apparatus 10 (and discussed in more detail below), is a protectant supply system 14, a flood system 16, infeed rollers 18, a front brush system 20, a side brush system 22, and a back brush system 24.

In a preferred embodiment and referring to FIGS. 1–7, the apparatus 10 includes side panels 26, 28 and basin 30, mounted to framework 12. The side panels may be made of any suitable material, such as, for example, ultra high molecular weight plastic (UHMW). The side panels 26, 28 and frame 12 may function as sidewalls of the apparatus 10 and structurally may be capable of receiving various components of the apparatus as well as function to retain and collect released protectant materials. The side panels 26, 28 are preferably vertically oriented. The catch basin 30 is attached to the framework 12 at a lower edge of side panels 26, 28 and extends underneath the flood system 16 and infeed rollers 18 and brush systems 20, 22 and 24. The framework 12, panels 26 and 28 with basin 30 define an interior 44 of the apparatus 10. The catch basin 30 is preferably tilted slightly from the horizontal to direct excess released protectant materials to a collecting container 42 positioned underneath catch basin 30. The excess protectant may be drawn, funneled or the like from the collecting container 42 and reused as appropriate.

The protectant supply system 14 may be any suitable fluid delivery pump capable of delivering flowable protectants, such as oil and latex based paints. The protectant supply system 14 is operably connected to the control system 34 so as to provide protectants in suitable amounts and at appropriate times. The protectant supply system 14 includes conventional fluid conveyances, such as pipes extending from a pump, with each pipe terminating in a fan jet nozzle 36 of flood system 16. It will be understood that the nozzles 36 are provided in sufficient number and oriented in the frame 12 so as to direct fluid protectants onto all exposed sides of the protectant passing through the apparatus 10.

Figure 5:
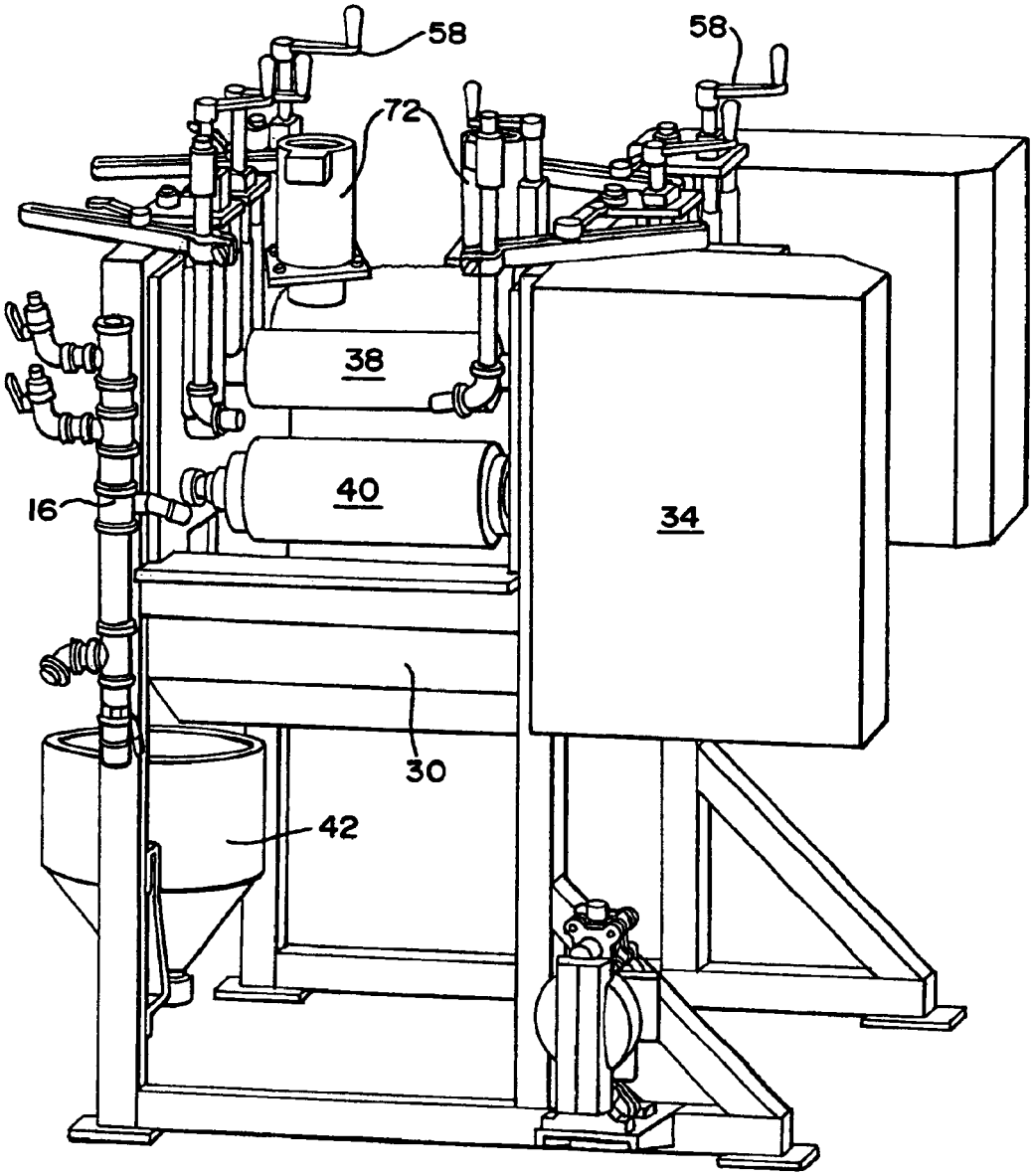
FIG. 5 is a perspective front view of one embodiment of an apparatus according to the present invention.

A control system 34 is provided to control the fluid protectant delivery system 14 as well as the motors 32. It will be understood that the control system 34 includes conventional control components and is considered to be within the ability of one of ordinary skill in the art to design and construct. Of course, the control system 34 will be designed and constructed to be operational dependent upon whether the motors are electrically or hydraulically actuated. Accordingly, the control system 34 will include components (for example, motors 32) and operating algorithms (not shown) to control electrical and/or hydraulic systems (not shown) of the apparatus 10. In order for the control system 34 to be easily accessed by an operator or maintenance personnel, it is preferable that the control system 34 is mounted on or near the frame 12 as shown in FIG. 5.

A set of motors 32 are arranged on an outer side of panel 26. The motors 32 may be electrical or fluid-driven (hydraulic). The motors 32 function to rotate the infeed rollers 18 and brush systems 20 and 24 so as to advance manufactured products through the apparatus 10 and rotate the brush systems. It will be understood that the motors 32 may vary in number. For example, one or two motors may be used to rotate the two shafts of the infeed rollers and/or any of the various brush systems. If two motors are used, the speed of both may be controlled separately or one motor may be used, as known in the art, by driving the roller or brush system with one or more gears, chains or other known drive mechanisms. The actual number of motors used may vary according to design variations, all of which are considered to be contemplated by the present invention. A preferred feature of the present invention is the mounting of the motors outside of the apparatus interior 44 defined by the framework and panels.

Figure 6:
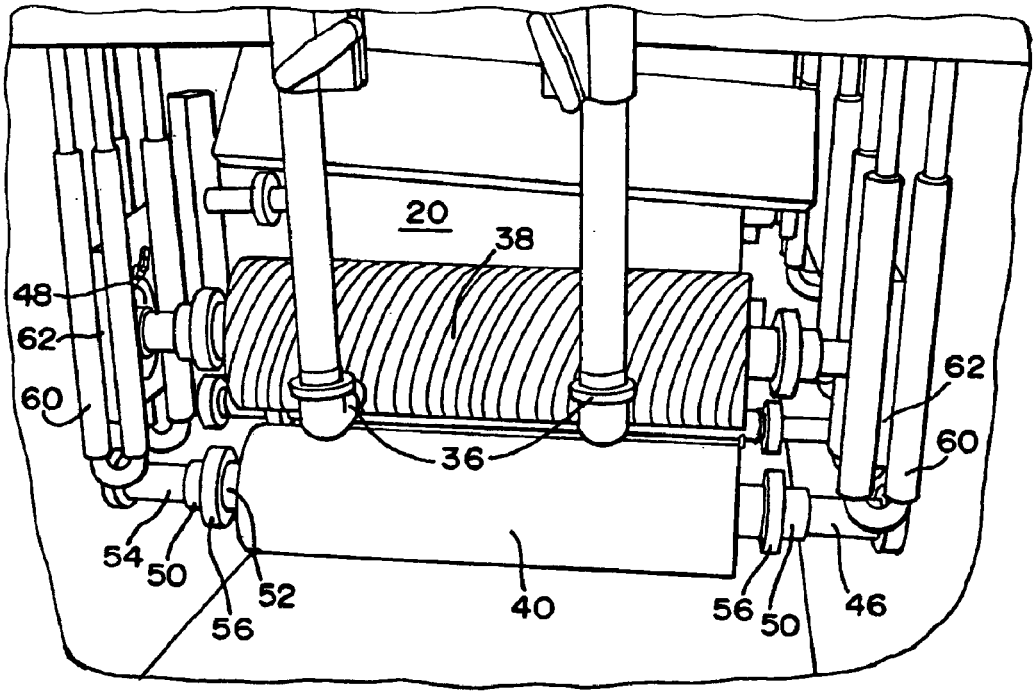
FIG. 6 is a perspective interior view of one embodiment of an apparatus according to the present invention illustrating the infeed station.
Figure 7:
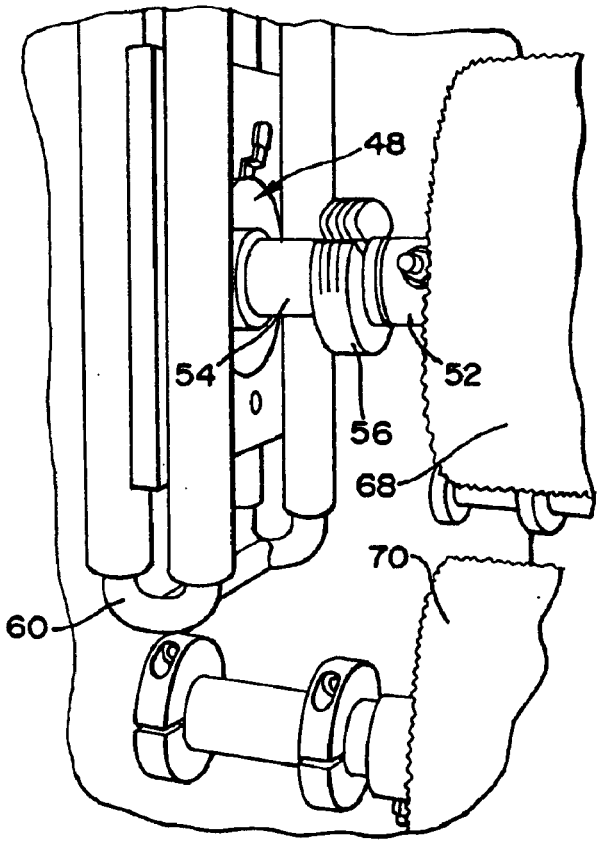
FIG. 7 is a perspective view of one embodiment of an apparatus according to the present invention illustrating a portion of the quick release and vertical adjusting mechanism.

As shown particularly in FIGS. 6 and 7, each of respective motors 32 include a motor drive shaft 46 extending from the motor which extends through a bearing 48 mounted near, on or in the side panel 26. The free ends of the motor shafts 46 preferably include a half cylinder cross sectional profile to connect to matching complementary profiles on respective shafts 52 of the rollers 18 and brushes 20 and 24.

In operational cooperation with the motor shafts 46 to support the ends of the respective shafts 52 of the rollers 18 and brush systems 20 and 24, corresponding stub shafts 54 are mounted to bearings 48 on or in the side panel 28, positioned opposite side panel 26. The stub shafts 54 each have a similar half cylinder cross section 50 (see FIG. 2) to couple with corresponding shaft ends 52 of the rollers 18 and brushes 20 and 24. This half-lap joint 50 enables a quick teardown of the apparatus 10 by permitting the shafts 52 of the infeed rollers 18 and brushes 20, 24 to be disconnected from the motor shafts 46 and stub shafts 54 and removed from the apparatus for replacement, modification and/or cleaning. The half lap joint 50 may be held together by any mechanism in the art. Preferably, a coupling or clamp 56, which is relatively quickly and easily fastened and released, is employed. In one preferred embodiment, the motors 32 are arranged in pairs 32A, 32B, each pair being vertically aligned, and operatively associated with a respective front brush system 20 or back brush system 24.

The portion of the apparatus 10 including the infeed rollers 18 may be considered a first station of the apparatus. The second and third stations of the apparatus may be considered to include the front brush system 20 and the back brush system 24, respectively.

As shown in FIG. 1, the first station infeed rollers 18 receive the manufactured product via the input end 13 of the apparatus, by feeding product in-between the infeed rollers 18. The infeed rollers 18 include a metering roller 38 positioned horizontally parallel to and above a drive roller 40.

The metering roller 38 is preferably a neoprene rubber cylinder (for example, 90 Durometer on the Shore A scale) with a spiral groove or land defining a spiral fiat strip for squeezing off excess protectant material as the product is drawn through the infeed rollers 18. The metering roller 38 is preferably biased, as by a spring (not shown), so as to develop a pinching action with the drive roller 40 and thus, draw the manufactured product through the infeed rollers 18 when rotated. The metering roller 38 may be permitted to rotate freely (unpowered) by contact with an advancing product or driven by a motor.

The drive roller 40 is preferably a steel cylinder (or functionally similar material) including a textured exterior. Preferably, the texture is a neuralized or cross-checked pattern on the outer surface of the roller 40. The texture of the roller 40 assists in gripping the product when pulling the product into the apparatus 10. The drive roller 40 is releasably and drivingly coupled to a motor 32.

The motor 32 attached to the drive roller 40 may be held vertically in a fixed position. In such an embodiment, the metering roller 38 of the infeed rollers 18 is provided with a vertical adjusting mechanism 58 to adjust the vertical position of the motor and metering roller 38 relative to the drive roller 40. The metering roller may be left to rotate by friction with the product as it is drawn through the apparatus 10 by drive roller 40. This permits the apparatus 10 to be used with a variety of sizes of products by adjusting the distance between rollers 38, 40 (and in a similar fashion, the brush systems).

Figure 3:
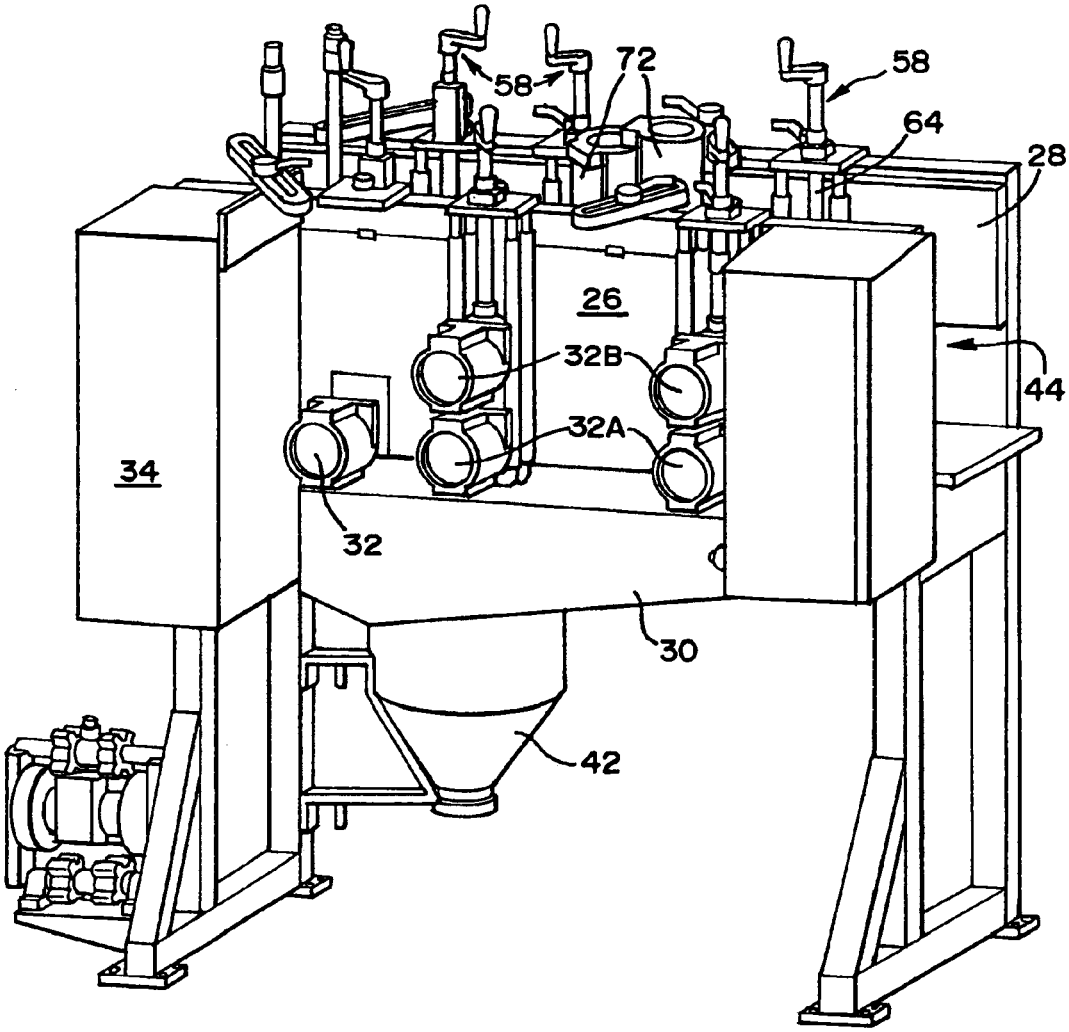
FIG. 3 is a perspective side view of one embodiment of an apparatus according to the present invention.
Figure 4:
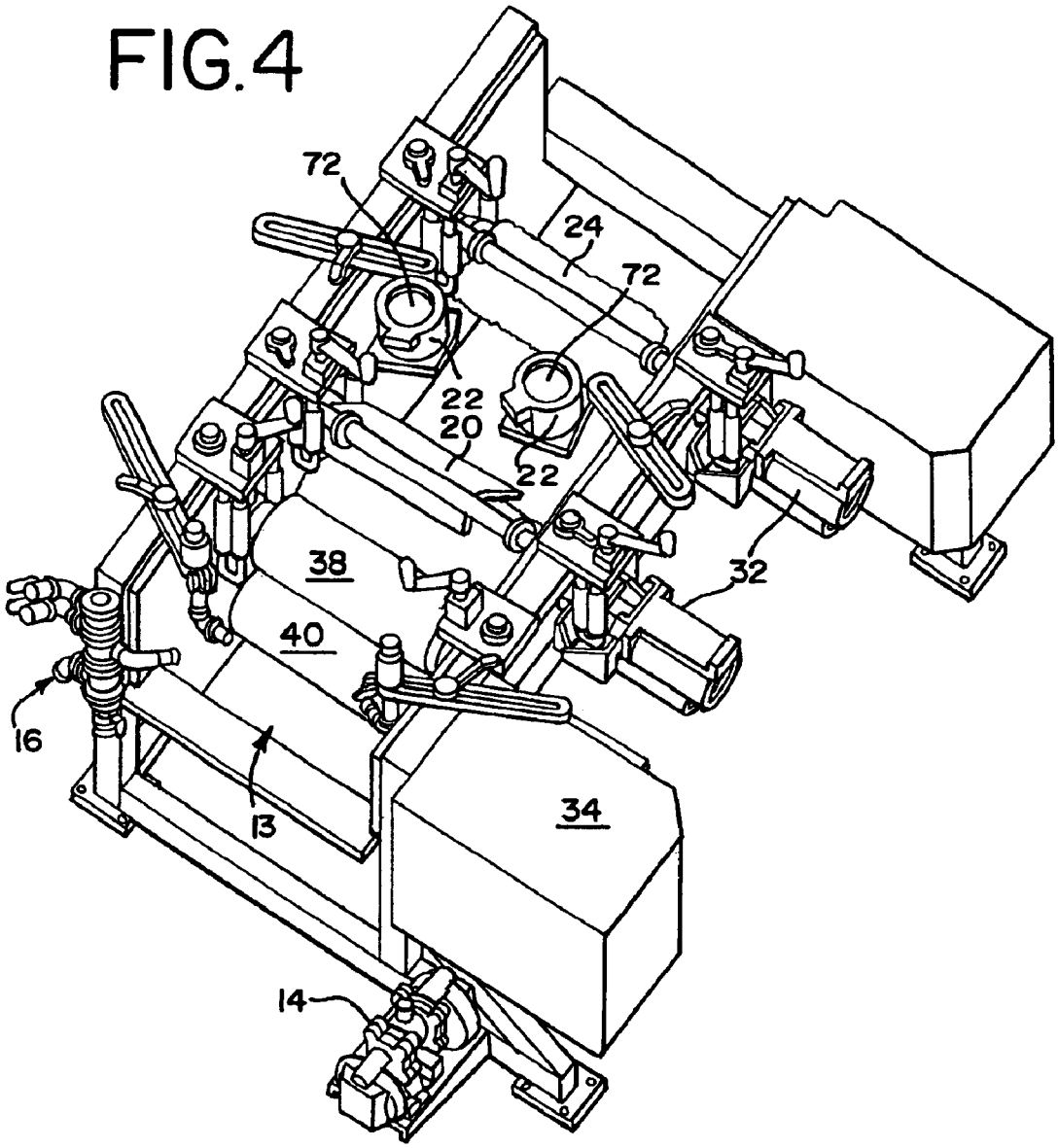
FIG. 4 is a perspective top view of one embodiment of an apparatus according to the present invention.

As shown in FIGS. 5 and 6, one preferred embodiment of the vertical adjusting mechanism 58 includes a pair of spaced parallel tracks 60. The tracks 60 are U-shaped tracks formed of metal and preferably encircled with sleeves of UHMW plastic. A rectangular plate 62 is positioned to ride vertically in the tracks 60. A bearing 48 is positioned on the plate 62 to rotatably support a motor shaft 46 (or stub shaft 52 positioned therethrough). As shown in FIGS. 3 and 6, a vertical screw assembly 64 is attached to the plate 62 which, when rotated or activated, raises and lowers the plate in the track, and thence the end of the shaft and the brush or roller attached thereto. The embodiment shown in FIG. 3 depicts respective vertical adjusting mechanisms 58 attached to the side panel 26 and on the inside surface of the side panel 28. It will be understood that a vertical adjusting mechanism 58 provided to adjust one end of each roller or brush will preferably have a corresponding adjusting mechanism for the other end to adjust each a similar amount.

The adjustable aspect of the metering roller 38 requires vertical slots (not shown) formed through the side panels 26, 28, and accordingly are provided with seals or splashguards (not shown) capable of discouraging penetration of protectant therethrough, which permitting rotational and vertical movement of a shaft passing therethrough. A preferred splashguard includes a pair of inward facing brushes extending over the slot.

Both rollers 38 and 40 are mounted on separate shafts 52, as discussed herein. As shown in FIGS. 6 and 7, each such shaft 52 includes one or more quick disconnect feature 50 designed to be quickly disassembled so as to remove the roller from the apparatus for replacement or cleaning, for example. Each of the brushes in the brush systems 22, 24 and 26 may be so mounted for a similar benefit.

Each respective shaft 52 extends through the axis of a roller 38, 40. The ends of the each shaft 52, outboard of the roller itself are split horizontally into a semi-circular extension (not shown) to match that of the drive shaft or stub shaft. The extension forms a half-lap joint 50 with a respective shaft 46 extending from a respective motor 32. Two C-shaped clamp halves 56 are assembled together to hold the half lap joint 50 together during operation of the apparatus 10. In an alternate embodiment, the quick disconnect feature includes a key or alignment pin (not shown) positioned in an axial bore formed cooperatively along the axis of each shaft and respective stub shaft or motor drive shaft. The key reduces any tendency for the quick disconnect feature to become misaligned. An important benefit of the quick disconnect feature is the ability to quickly disassemble the apparatus for cleaning or changeovers and so on. The same type of quick disconnect feature may be used with all of the brush systems as well to provide the same benefit.

As shown in FIGS. 1 and 7, the second station includes the front brush system 20, with parallel upper and lower brushes 68, 70 releasably coupled to motors 32 and operated in such a direction opposite that of the infeed rollers 18, known as reverse brushing. The brushes 68, 70 are preferably spiral wound multifilament brushes having various diameter filaments, ranging in diameter, for example from 0.008–0.018 inches. As with the metering roller 38, the upper brush 68 of the front brush system 20 is vertically adjustable to adapt to different sized manufactured products. The brushes 68, 70 preferably operate to spread and smooth the protectant onto the manufactured product and assist in penetratingly driving the protectant into the material of the product, especially in the case of penetrating oil based protectants. Also, the brushes 68, 70 operate to remove excess protectant from the surfaces of the manufactured product.

A further pair of motors 72 is mounted to a respective pair of side brushes 22 positioned between front brush system 20 and back brush system 24. The side brushes 22 may be easily positioned along the outside edges of a manufactured product being passed through the apparatus. The side brushes are rotated by motors 72 so as to reverse brush the product as with the front and back brush systems 20, 24. Preferably, the side brushes 22 are movably adjustable to adjust to different sized manufactured products.

The third station includes the rear brush system 24, with parallel upper and lower brushes releasably coupled to motors 32 and operated in such a direction opposite that of the infeed rollers 18, i.e., reverse brushing. The brushes are preferably spiral wound brushes. The third station is identically provided as the second station 20.

Thus, while the invention has been described with respect to certain preferred embodiments, it will be understood by those of skill in the art that there are modifications, substitutions and other changes that can be made, yet will still fall within the intended scope of the invention, as set forth in the following claims.

What is claimed is:

1. An apparatus for applying a flowable material to a manufactured building product comprising:

a framework;

a flood system arranged so as to apply the flowable material to manufactured building product conveyed through said apparatus;

an infeed station including a drive roller and a metering roller, each of said drive roller and metering roller being releasably coupled to and driven by one or more drive motor positioned outside of said framework;

an adjusting mechanism for adjusting the relative vertical position of said metering roller with respect to said drive roller; and at least one brush station including an upper brush and a lower brush, said brush station being positioned downstream from said infeed station, said upper brush and said lower brush releasably coupled to and driven by one or more brush motor positioned outside of said framework.

2. The apparatus of claim 1 wherein said drive roller is positioned below and parallel to said metering roller.

3. The apparatus of claim 1 wherein said drive roller includes a textured surface.

4. The apparatus of claim 1 wherein said metering roller includes a neoprene outer surface.

5. The apparatus of claim 4 wherein said neoprene surface includes a spiral flat strip formed thereupon.

6. The apparatus of claim 5 wherein said neoprene surface includes a spiral groove defined by said spiral flat strip.

7. The apparatus of claim 1 wherein said flood system applies the flowable material to the manufactured product before said infeed station.

8. The apparatus of claim 1 wherein said at least one brush station includes a first brush station including an upper brush and a lower brush positioned downstream from said infeed station to receive the manufactured product therefrom and a second brush station including an upper brush and a lower brush, said second brush station positioned down stream from said first brush station to receive the manufactured product therefrom.

9. The apparatus of claim 8 wherein both said first and second brush stations are adapted to brush upper and lower surfaces of the manufactured product.

10. The apparatus of claim 9 further comprising a side brush system adapted to contact the sides of the manufactured product.

11. The apparatus of claim 10 wherein said side brush system is positioned between first brush station and said second brush station.

12. The apparatus of claim 10 wherein said side brush system is adapted to brush side surfaces of the manufactured product.

13. The apparatus of claim 1 wherein said adjusting mechanism vertically adjusts said metering roller.

14. The apparatus of claim 1 further comprising an adjusting mechanism for adjusting the relative vertical position of said upper brush with respect to said lower brush.

15. The apparatus of claim 1 wherein said framework includes a pair of spaced side panels.

16. The apparatus of claim 15 further comprising a catch basin extending between said pair of spaced side panels and positioned below said infeed station and said brush station.

17. The apparatus of claim 15 wherein said drive motor and said one or more brush motor are mounted outside of said spaced side panels.

18. The apparatus of claim 1 wherein one or more of said drive roller, said metering roller, said upper brush and said lower brush is quick release mounted.

19. The apparatus of claim 1 wherein said framework includes an infeed end, said infeed station being positioned adjacent said infeed end.

* * * * *